US006668990B2

(12) United States Patent
Humiston, Jr.

(10) Patent No.: US 6,668,990 B2
(45) Date of Patent: Dec. 30, 2003

(54) EASILY INSPECTABLE LUGGAGE

(76) Inventor: Norman John Humiston, Jr., 1117 Rte. 29, Schuylerville, NY (US) 12871

( * ) Notice: Subject to any disclaimer, the term of this patent is extended or adjusted under 35 U.S.C. 154(b) by 0 days.

(21) Appl. No.: 10/095,726

(22) Filed: Mar. 12, 2002

(65) Prior Publication Data

US 2003/0173171 A1 Sep. 18, 2003

(51) Int. Cl.[7] ..... A45C 5/00; A45C 5/02; A45C 5/12

(52) U.S. Cl. ..... 190/109; 190/40; 190/107; 190/111; 190/901; 383/106

(58) Field of Search ..... 190/107, 111, 190/901, 40, 109; 383/39, 106

(56) References Cited

U.S. PATENT DOCUMENTS

| | | | | | |
|---|---|---|---|---|---|
| 1,705,149 | A | * | 3/1929 | Brady | 190/901 X |
| 2,254,578 | A | * | 9/1941 | O'Brien | 190/107 |
| 2,319,497 | A | * | 5/1943 | Franklin | 190/107 X |
| 3,370,629 | A | * | 2/1968 | Neuman | 383/106 X |
| 3,530,961 | A | * | 9/1970 | Weissenbach | 383/39 X |
| 3,777,862 | A | * | 12/1973 | Zipper | 190/107 |
| 3,807,537 | A | * | 4/1974 | O'Reilly | 383/106 X |
| 4,401,219 | A | * | 8/1983 | Mink | 383/39 X |
| 4,596,397 | A | * | 6/1986 | Conti | 190/18 A X |
| 4,685,570 | A | * | 8/1987 | Medow | 190/901 X |
| 4,693,344 | A | * | 9/1987 | Shuler | 190/107 |
| 4,753,329 | A | * | 6/1988 | Choy | 190/107 X |
| 4,960,204 | A | * | 10/1990 | Young et al. | 383/39 X |
| 4,967,986 | A | * | 11/1990 | Schildkraut | 383/39 X |
| 5,351,813 | A | * | 10/1994 | Golovan | 383/39 X |
| 5,440,102 | A | | 8/1995 | Pena | |
| 5,547,077 | A | * | 8/1996 | Wang | 383/39 X |
| D412,616 | S | | 8/1999 | Livingston | |
| 5,947,604 | A | | 9/1999 | Bang et al. | |
| 6,070,729 | A | * | 6/2000 | Barnes | 383/39 X |
| 6,193,034 | B1 | * | 2/2001 | Rournier | 190/107 |
| 6,276,501 | B1 | * | 8/2001 | Tong | 190/901 X |
| 6,296,094 | B1 | * | 10/2001 | Knecht | 190/901 X |
| 6,305,590 | B1 | | 10/2001 | Hayes | |
| 6,328,158 | B1 | * | 12/2001 | Bisbal et al. | 383/106 X |
| 6,334,519 | B1 | * | 1/2002 | Tong | 190/107 |

FOREIGN PATENT DOCUMENTS

| | | | | |
|---|---|---|---|---|
| EP | 373318 | * | 6/1990 | 190/901 |

* cited by examiner

*Primary Examiner*—Sue A. Weaver
(74) *Attorney, Agent, or Firm*—Kristen L. Ashdown, Esq.

(57) ABSTRACT

The present invention provides a substantially transparent roll-up or fold-up piece of luggage having a plurality of substantially transparent enclosed compartments therein that may be unrolled or unfolded for neat and easy inspection without having to remove the contents of the luggage.

17 Claims, 5 Drawing Sheets

EASILY INSPECTABLE LUGGAGE

BACKGROUND OF THE INVENTION

1. Technical Field

The present invention relates generally to luggage, and more particularly, to luggage that may be easily inspected by airport security personnel, and the like.

2. Related Art

Current luggage designs hinder airport security personnel needing to perform a routine luggage search. Due to the vast expanse within the open inner cavity of most luggage designs, security personnel are forced to open the luggage and remove at least a portion of the contents, or riffle through the contents of the luggage, to be sure that no unlawful items are present. This is time consuming and frustrating for both airport security personnel and airport patrons. Accordingly, there exists a need in the industry for a piece of luggage enabling faster and easier inspection.

SUMMARY OF THE INVENTION

The first embodiment of the present invention provides a piece of luggage, comprising: a substantially transparent flexible backer; a plurality of substantially transparent enclosed compartments secured to the flexible backer; and a fastening mechanism attached to the flexible backer to secure the luggage in a closed position.

The second embodiment of the present invention provides a piece of luggage, comprising: a flexible backer; a plurality of flaps hingedly secured to the backer; and a fastening mechanism attached to an outer surface of the backer to secure the luggage in a rolled up position.

The third embodiment of the present invention provides a roll-up piece of luggage having a plurality of compartments therein.

The foregoing and other features and advantages of the invention will be apparent from the following more particular description of the embodiments of the invention.

BRIEF DESCRIPTION OF THE DRAWINGS

The embodiments of this invention will be described in detail, with reference to the following figures, wherein like designations denote like elements, and wherein.

DESCRIPTION OF THE PREFERRED EMBODIMENTS

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc. Although the drawings are intended to illustrate the present invention, the drawings are not necessarily drawn to scale.

Figure 1:
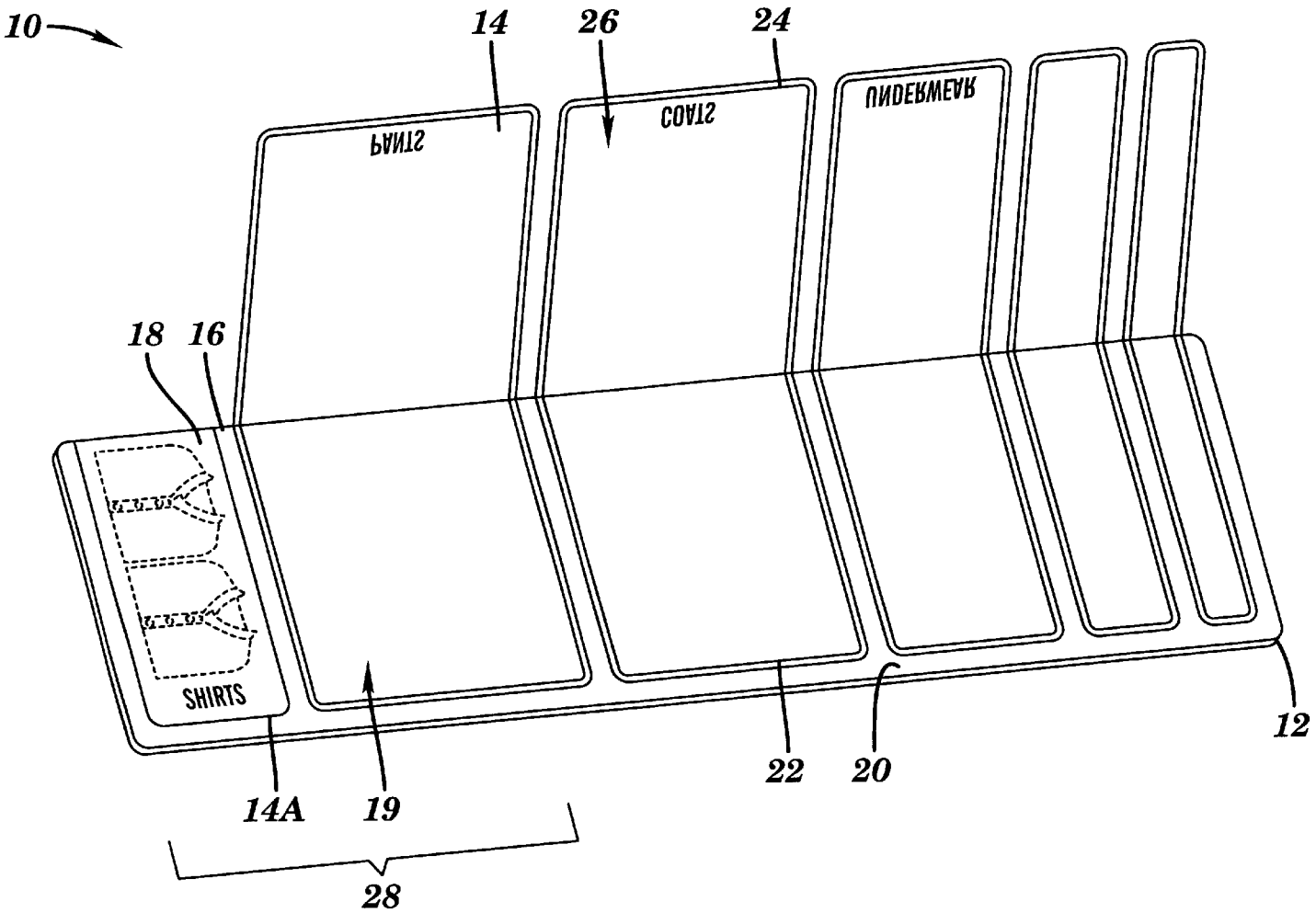
FIG. 1 depicts a piece of luggage in accordance with a first embodiment of the present invention.

Referring to the drawings, FIG. 1 depicts a piece of luggage 10 in accordance with a first embodiment of the present invention. The luggage 10 includes a back piece or backer 12 having a plurality of flaps 14 hingedly attached to a side 16 of the backer 12. In this example, the first flap 14A is in a closed or storage position forming an enclosed compartment 18 for the storage of clothing and other similar items. The remaining flaps 14 are in an open or loading position wherein cavities 19 are available for the insertion of clothing and other similar items.

In the storage position the flaps 14 are secured to an inner surface 20 of the backer 20. For example, the three non-hinged sides of the flaps 14 are secured to the backer 12 by fasteners 22 on the inner surface 20 of the backer 12 and mating fasteners 24 on an inner surface 26 of the flaps 14. The fasteners 22, 24 may comprise hook and loop fasteners, e.g., Velcro™, snaps, zippers, etc.

The backer 12 and flaps 14 comprise a flexible material, such as flexible plastic, or other similar material, that may be easily closed in various manners, e.g., by rolling up, folding up, etc. The backer 12 and flaps 14 may be formed of a substantially transparent material, e.g., clear plastic, thus allowing for easy inspection when the luggage 10 is in an open position, e.g., rolled out. In particular, those performing the inspection of the luggage 10 can easily see all contents within each compartment 18 from both front and back, or inside and outside, of the luggage 10.

Figure 2:
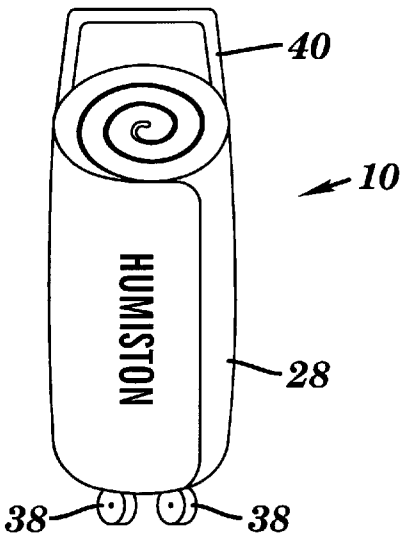
FIG. 2 depicts the luggage of FIG. 1 in a rolled up position having a pair of wheels, a handle, and a customized non-transparent insert.

A portion 28 of the backer 12 may be formed of a non-transparent material, or allow for a non-transparent insert so the contents of the luggage 10 are not visible when the luggage 10 is in a closed position, e.g., rolled up or folded up. Furthermore, the non-transparent insert may be costomizable. For example, as illustrated in FIG. 2, one could right one's name on the insert to easily identify one's luggage 10 at the baggage claim.

Each compartment 18 may be formed of a limited size, thereby restricting the amount of space available for the storage of items within each compartment 18. This will make inspection of the luggage 10 easier since all contents within each compartment 18 are visible from either the front or the back, or both sides, of the luggage 10 while the compartments 18 are in a closed position. Accordingly, those performing an inspection of the luggage 10 will not need to open the compartments 18 to see the contents of the compartments 18.

As illustrated in FIG. 1, the compartments 18 may be labeled for easier packing. For example, the compartments 18, or the flaps 14 corresponding to each compartment 18, may be labeled coat, pants/shorts, shirts, undergarments, socks/shoes, and vanity, to assist persons during packing to know what will fit in each different size compartment 18. Also, this will assist the airport security personnel during an inspection to know what type of items are in each compartment 18, and provide some uniformity of texture within each compartment 18 when a security personnel inspects by touching or patting down each closed compartment 18.

Figure 3:
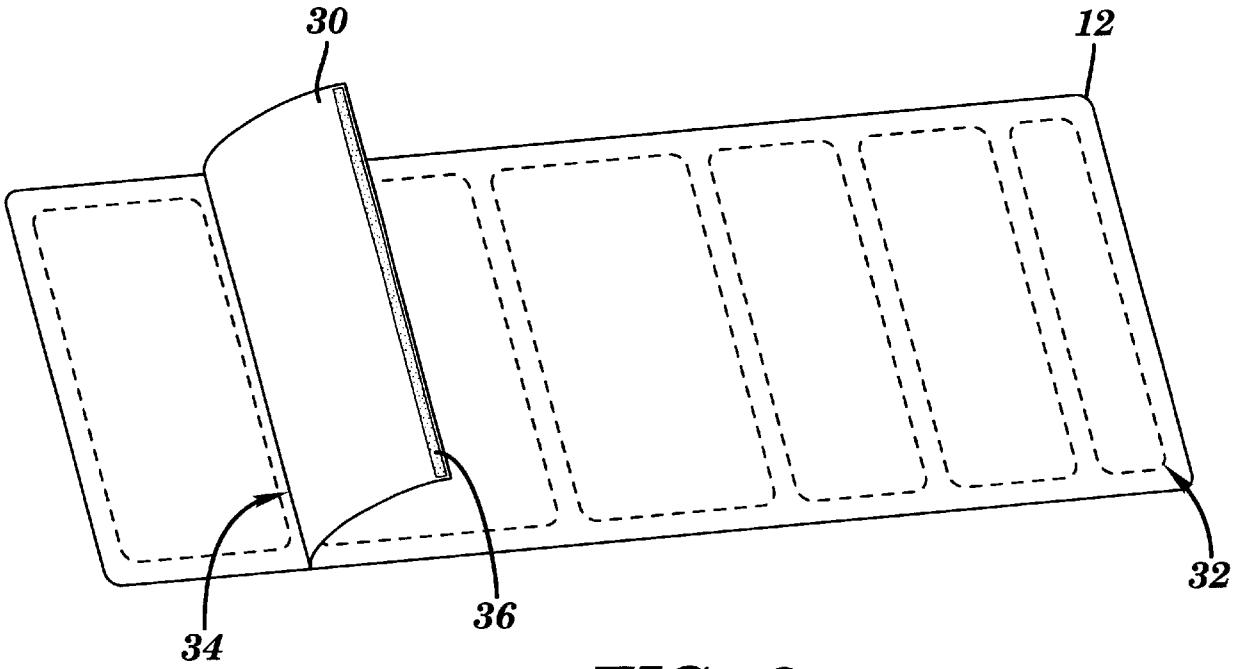
FIG. 3 depicts a fastening mechanism of the luggage.
Figure 4:
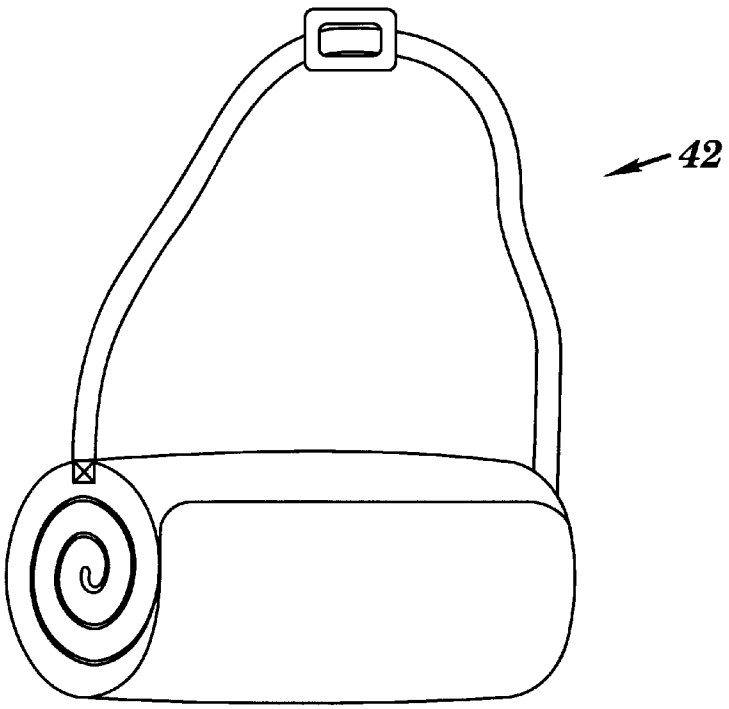
FIG. 4 depicts the luggage of FIG. 1 in a rolled up position having a shoulder strap.

The luggage 10 further includes a fastening mechanism 30 attached to an outer surface 32 of the backer 12, as illustrated in FIGS. 3 and 4. The fastening mechanism 30 is securely attached to the outer surface 32 of the backer 12 at one end 34 by stitching, etc., and releasably attached to the outer surface 32 of the backer 12 at a second end 36 by a releasable fastener, such as a hook and loop fastener, e.g., Velcro™, zipper, snaps, buckles, tie straps, etc.

Referring back to FIG. 2, the luggage 10 may include a pair of wheels 38 attached to the outer surface 32 of the backer 12. Likewise, a removable handle 40 may be attached to the outer surface 32 of the backer 12 opposite the wheels 38, thus enabling a person to pull the luggage 10 along the ground rather than carrying the luggage 10. The wheels 38 and handle 40 may be formed of a nonmetal material, such as plastic, etc., so metal detectors are not set off, a metal material, or other similarly used material. Alternatively, the luggage 10 may include a shoulder strap 42 attached to first and second sides of the backer 12, as illustrated in FIG. 4.

Figure 6:
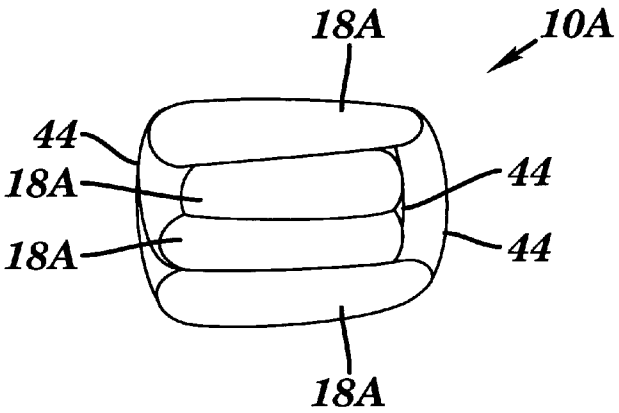
FIG. 6 depicts the luggage of FIG. 5 in a folded up position.
Figure 5:
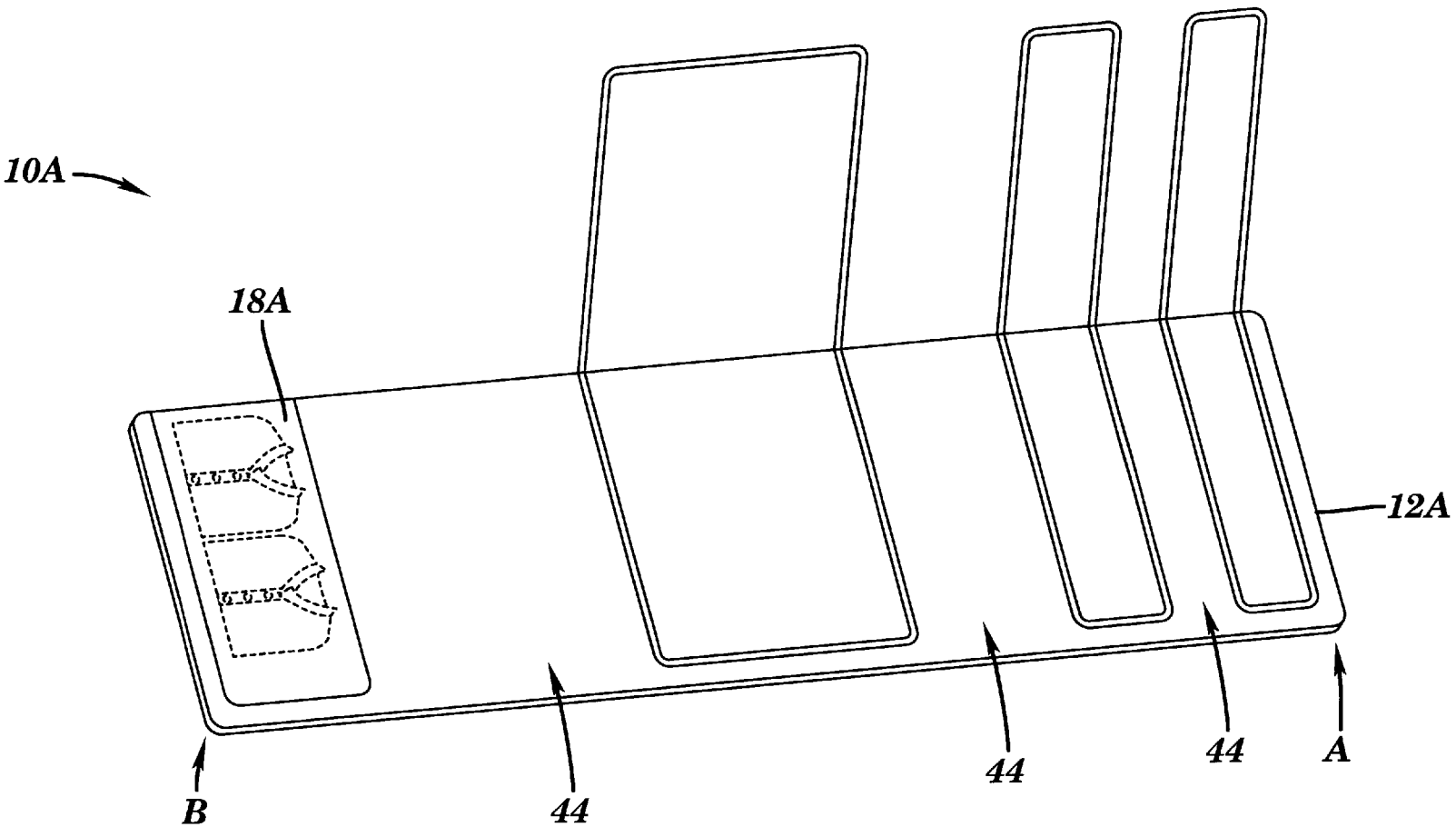
FIG. 5 depicts a piece of luggage in accordance with a second embodiment of the present invention.

In accordance with a second embodiment of the present invention, FIG. 5 illustrates a piece of luggage 10A that may be closed, e.g., by folding, to form a substantially rectangular piece of luggage 10A. The backer 12A is similar to that of the backer 12 described in the first embodiment, however, the backer 12A of the second embodiment has a plurality of gaps or spaces 44 between each compartment 18A. As illustrated, the spaces 44 become progressively larger from the area of the luggage 10 that will form the center A of the luggage 10 when in a closed position, to the outer layers B of the luggage 10 to allow for a more compact piece of luggage 10 when closed, as illustrated in FIG. 6. The spaces 44 may also have compartments for the placement of additional items, such as shoes, socks, etc.

Figure 7:
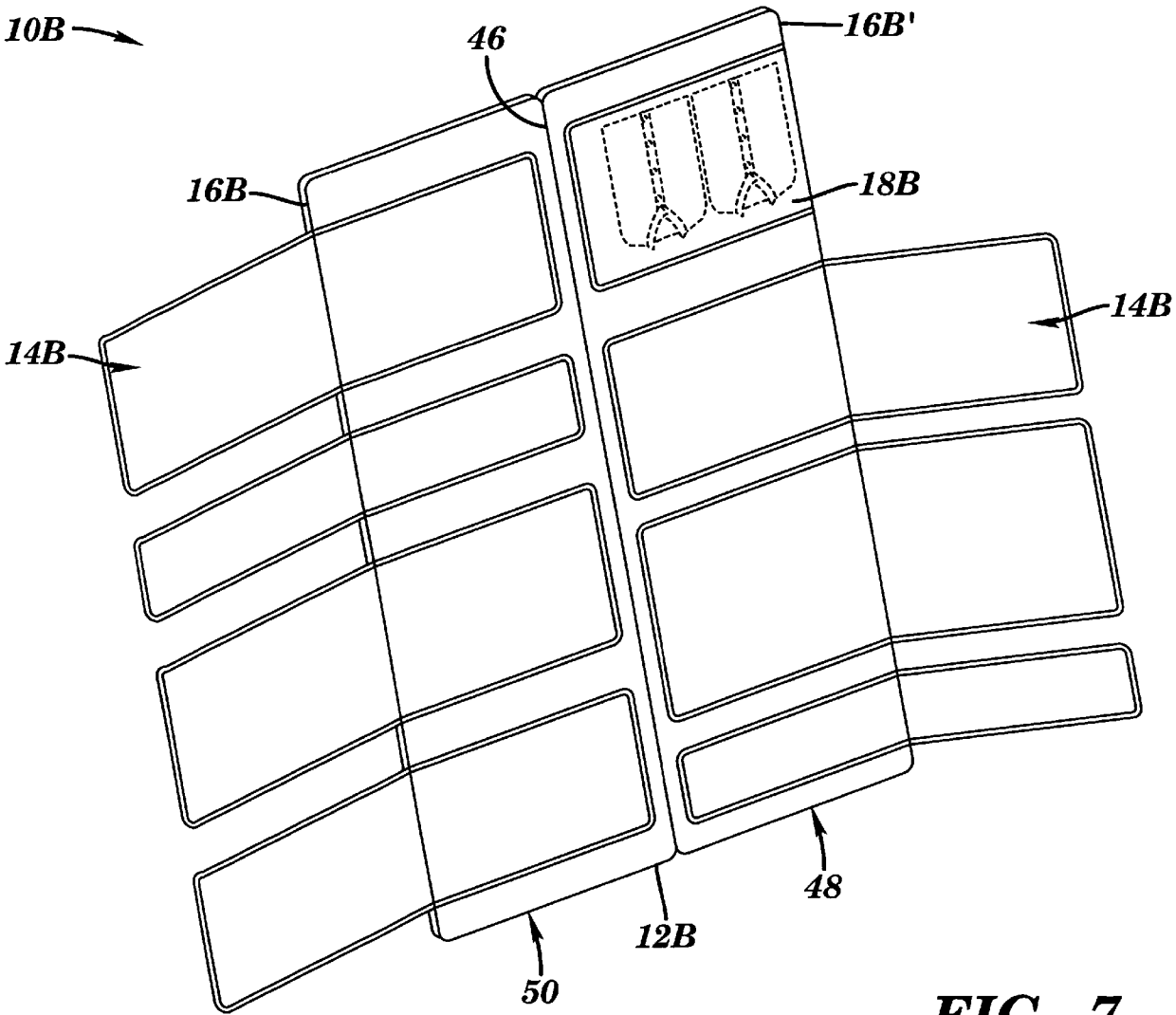
FIG. 7 depicts a piece of luggage in accordance with a third embodiment of the present invention.

In accordance with a third embodiment of the present invention, FIG. 7 illustrates a piece of luggage 10B having a plurality of flaps 14B hingedly attached to each side 16B, 16B' of the backer 12B, such that multiple compartments 18B, (similar to the compartments 18 of the first and second embodiments described above), are formed on each side of a dividing line 46. When ready to close the luggage 10B, a first section 48 of the backer 12B can be folded, along dividing line 46, over onto a second section 50 of the backer 12B, then the backer 12B can be rolled or folded up in accordance with the first or second embodiment described above.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A piece of luggage, comprising:

a substantially transparent flexible backer;

a plurality of substantially transparent flaps securely fastened to the flexible backer on a first side of each flap, and detachably fastened to the flexible backer on at least two sides of each flap; and a fastening mechanism attached to the flexible backer to secure the luggage in a closed position.

2. The piece of luggage of claim 1, wherein the luggage is rolled up in the closed position.

3. The piece of luggage of claim 1, wherein the luggage is folded up in the closed position.

4. The piece of luggage of claim 3, wherein the luggage includes a space between each of the flaps to allow for folding of the luggage.

5. The piece of luggage of claim 4, wherein the spaces increase in size from an end of the backer at a center of the folded luggage to an end of the backer near a perimeter of the folded luggage.

6. The piece of luggage of claim 1, wherein the luggage includes two sets of flaps separated by a dividing line.

7. The piece of luggage of claim 1, wherein the backer has a non-transparent portion to hide the contents of the luggage when the luggage is in a closed position.

8. The piece of luggage of claim 1, further comprising:

a pair of wheels affixed to an outer surface of the backer; and a handle affixed to the outer surface of the backer opposite the wheels.

9. The piece of luggage of claim 1, further including a shoulder strap attached to a first and a second side of the backer.

10. The piece of luggage of claim 1, wherein the plurality of flaps are detachably fastened to the flexible backer on three sides of each compartment.

11. A piece of luggage, comprising:

a substantially transparent flexible backer;

a plurality of substantially transparent flaps securely fastened to the backer on a first side of the flaps and detachably fastened to the backer on at least two sides of the flaps, wherein each flap fastened to the backer forms a compartment; and a fastening mechanism attached to an outer surface of the backer to secure the luggage in a closed position.

12. The piece of luggage of claim 11, wherein the backer has a non-transparent portion to hide the contents of the luggage when the luggage is in the closed position.

13. The piece of luggage of claim 11, further comprising:

a pair of wheels affixed to the outer surface of the backer; and a handle affixed to the outer surface of the backer opposite the wheels.

14. The piece of luggage of claim 11, further including a shoulder strap attached to a first and a second side of the backer.

15. The piece of luggage of claim 11, wherein the luggage further includes two sets of compartments separated by a dividing line.

16. A piece of luggage, comprising:

a substantially transparent flexible backer;

a plurality of substantially transparent enclosed compartments secured to the flexible backer, having a space between each compartment, wherein the spaces increase in size from a first end of the backer to a second end of the backer; and a fastening mechanism attached to the flexible backer to secure the luggage in a closed position.

17. A piece of luggage, comprising:

a substantially transparent backer;

a plurality of substantially transparent flaps securely fastened to the backer on a first side of the flaps and detachably fastened to the backer on at least two sides of the flaps, wherein each flap fastened to the backer forms a compartment; and a fastening mechanism attached to an outer surface of the backer to secure the luggage in a closed position.

* * * * *